US009322249B2

(12) United States Patent
Fripp et al.

(10) Patent No.: US 9,322,249 B2
(45) Date of Patent: Apr. 26, 2016

(54) ENHANCED EXPANDABLE TUBING RUN THROUGH PRODUCTION TUBING AND INTO OPEN HOLE

(71) Applicant: Halliburton Energy Services, Inc., Houston, TX (US)

(72) Inventors: Michael Fripp, Carrollton, TX (US); John Gano, Carrollton, TX (US); Peter Besselink, Enschede (NL); Wilfried Van Moorleghem, Herk (BE)

(73) Assignee: Halliburton Energy Services, Inc., Houston, TX (US)

( * ) Notice: Subject to any disclaimer, the term of this patent is extended or adjusted under 35 U.S.C. 154(b) by 497 days.

(21) Appl. No.: 13/672,996

(22) Filed: Nov. 9, 2012

(65) Prior Publication Data

US 2013/0220644 A1 Aug. 29, 2013

Related U.S. Application Data

(60) Provisional application No. 61/602,111, filed on Feb. 23, 2012.

(51) Int. Cl.

| | |
|---|---|
| ***E21B 33/13*** | (2006.01) |
| ***E21B 43/08*** | (2006.01) |
| ***E21B 43/12*** | (2006.01) |

(Continued)

(52) U.S. Cl.

CPC ..... *E21B 43/12* (2013.01); *E21B 33/124* (2013.01); *E21B 33/1208* (2013.01); *E21B 33/13* (2013.01); *E21B 34/06* (2013.01); *E21B 43/08* (2013.01); *E21B 43/103* (2013.01); *E21B 43/106* (2013.01); *E21B 43/108* (2013.01)

(58) Field of Classification Search

CPC . E21B 43/108; E21B 33/1208; E21B 33/124; E21B 43/103; E21B 33/10; E21B 43/12

See application file for complete search history.

(56) References Cited

U.S. PATENT DOCUMENTS

| | | | |
|---|---|---|---|
| 1,301,285 | A | 4/1919 | Leonard |
| 1,476,830 | A | 12/1923 | Newell |

(Continued)

FOREIGN PATENT DOCUMENTS

| | | | |
|---|---|---|---|
| EP | 1223305 | A2 | 7/2002 |
| EP | 1717411 | A1 | 11/2006 |

(Continued)

OTHER PUBLICATIONS

International Search Report and Written Opinion for PCT/US2013/023733 dated Jun. 26, 2013.

(Continued)

*Primary Examiner* — Nicole Coy

(74) *Attorney, Agent, or Firm* — McDermott Will & Emery LLP; Scott Richardson

(57) ABSTRACT

Disclosed is a downhole completion assembly for sealing and supporting an open hole section of a wellbore and filtering fluids passing therethrough. One system includes a sealing structure arranged within the open hole section and being movable between a contracted configuration and an expanded configuration, the sealing structure having one or more perforations defined therein, and a filter device arranged about the sealing structure so as to radially overlap the one or more perforations, the filter device being configured to screen fluids passing through the one or more perforations.

19 Claims, 5 Drawing Sheets

(51) Int. Cl.

| | |
|---|---|
| ***E21B 34/06*** | (2006.01) |
| ***E21B 43/10*** | (2006.01) |
| ***E21B 33/12*** | (2006.01) |
| ***E21B 33/124*** | (2006.01) |

(56) References Cited

U.S. PATENT DOCUMENTS

| | | | |
|---|---|---|---|
| 3,203,451 | A | 8/1965 | Vincent |
| 3,477,506 | A | 11/1969 | Malone |
| 3,818,734 | A | 6/1974 | Bateman |
| 4,484,625 | A | 11/1984 | Barbee, Jr. |
| 5,343,949 | A | 9/1994 | Ross et al. |
| 5,366,012 | A | 11/1994 | Lohbeck |
| 5,597,042 | A | 1/1997 | Tubel et al. |
| 5,609,178 | A | 3/1997 | Hennig et al. |
| 5,635,675 | A | 6/1997 | Houga |
| 6,142,230 | A | 11/2000 | Smalley et al. |
| 6,253,850 | B1 | 7/2001 | Nazzai et al. |
| 6,322,109 | B1 | 11/2001 | Campbell et al. |
| 6,457,533 | B1 | 10/2002 | Metcalfe |
| 6,478,092 | B2 | 11/2002 | Voll et al. |
| 6,695,054 | B2 | 2/2004 | Johnson et al. |
| 6,695,067 | B2 | 2/2004 | Johnson et al. |
| 6,719,064 | B2 | 4/2004 | Price-Smith et al. |
| 6,725,918 | B2 | 4/2004 | Gano |
| 6,725,934 | B2 | 4/2004 | Coronado et al. |
| 6,782,953 | B2 | 8/2004 | Maguire et al. |
| 6,834,725 | B2 | 12/2004 | Whanger et al. |
| 6,854,522 | B2 | 2/2005 | Brezinski et al. |
| 6,863,130 | B2 | 3/2005 | Steele et al. |
| 6,920,935 | B2 | 7/2005 | Metcalfe |
| 7,048,048 | B2 | 5/2006 | Nguyen et al. |
| 7,108,083 | B2 | 9/2006 | Simonds et al. |
| 7,124,821 | B2 | 10/2006 | Metcalfe et al. |
| 7,124,830 | B2 | 10/2006 | Metcalfe |
| 7,152,687 | B2 | 12/2006 | Gano |
| 7,172,027 | B2 | 2/2007 | Simpson et al. |
| 7,216,706 | B2 | 5/2007 | Echols et al. |
| 7,252,142 | B2 | 8/2007 | Brezinski et al. |
| 7,341,110 | B2 | 3/2008 | Doane et al. |
| 7,404,437 | B2 | 7/2008 | Brezinski et al. |
| 7,758,628 | B2 | 7/2010 | Besselink |
| 7,777,644 | B2 | 8/2010 | Madhavan et al. |
| 7,895,726 | B2 | 3/2011 | Maguire |
| 8,230,913 | B2 | 7/2012 | Hart et al. |
| 8,360,142 | B2 | 1/2013 | Durst et al. |
| 8,776,876 | B2 | 7/2014 | Hart et al. |
| 8,776,899 | B2 | 7/2014 | Fripp et al. |
| 9,169,724 | B2 | 10/2015 | Fripp et al. |
| 2002/0046840 | A1 | 4/2002 | Schetky et al. |
| 2002/0092648 | A1 | 7/2002 | Johnson et al. |
| 2002/0125008 | A1 | 9/2002 | Wetzel et al. |
| 2002/0162664 | A1 | 11/2002 | Bode et al. |
| 2002/0189696 | A1 | 12/2002 | Simpson et al. |
| 2003/0047322 | A1 | 3/2003 | Maguire et al. |
| 2003/0056948 | A1 | 3/2003 | Cameron |
| 2003/0089496 | A1 | 5/2003 | Price-Smith et al. |
| 2003/0183395 | A1 | 10/2003 | Jones |
| 2003/0234111 | A1 | 12/2003 | Echols et al. |
| 2004/0060695 | A1 | 4/2004 | Castano-Mears et al. |
| 2004/0074642 | A1 | 4/2004 | Price-Smith et al. |
| 2004/0159446 | A1 | 8/2004 | Haugen et al. |
| 2004/0168799 | A1 | 9/2004 | Simonds et al. |
| 2004/0251033 | A1 | 12/2004 | Cameron et al. |
| 2005/0077052 | A1 | 4/2005 | Ohmer |
| 2005/0279514 | A1 | 12/2005 | Metcalfe |
| 2006/0037745 | A1 | 2/2006 | Hart et al. |
| 2007/0029082 | A1 | 2/2007 | Giroux et al. |
| 2007/0034386 | A1 | 2/2007 | Henry |
| 2007/0084637 | A1 | 4/2007 | Orban et al. |
| 2007/0095532 | A1 | 5/2007 | Head et al. |
| 2007/0267201 | A1 | 11/2007 | Brezinski et al. |
| 2008/0149349 | A1 | 6/2008 | Hiron et al. |
| 2008/0230234 | A9 | 9/2008 | Gano et al. |
| 2009/0151957 | A1 | 6/2009 | Sickle et al. |
| 2009/0205843 | A1 | 8/2009 | Gandikota et al. |
| 2009/0301733 | A1 | 12/2009 | Shuster et al. |
| 2010/0071911 | A1 | 3/2010 | Carree |
| 2010/0122820 | A1 | 5/2010 | Holland |
| 2010/0243277 | A1 | 9/2010 | Ring |
| 2010/0314130 | A1 | 12/2010 | Durst et al. |
| 2011/0214855 | A1 | 9/2011 | Hart et al. |
| 2011/0247813 | A1 | 10/2011 | Moen |
| 2013/0056228 | A1 | 3/2013 | Gruetzmann et al. |
| 2013/0220640 | A1 | 8/2013 | Fripp et al. |
| 2013/0220641 | A1 | 8/2013 | Fripp et al. |
| 2013/0220642 | A1 | 8/2013 | Fripp et al. |
| 2013/0220643 | A1 | 8/2013 | Fripp et al. |
| 2014/0090857 | A1 | 4/2014 | Fripp et al. |
| 2014/0196914 | A1 | 7/2014 | Ring et al. |
| 2015/0075816 | A1 | 3/2015 | Jacob |

FOREIGN PATENT DOCUMENTS

| | | | |
|---|---|---|---|
| GB | 2371064 | A | 7/2002 |
| GB | 2401131 | A | 11/2004 |
| WO | 2005003511 | A1 | 1/2005 |
| WO | 2013126190 | A1 | 8/2013 |
| WO | 2013126191 | A1 | 8/2013 |
| WO | 2013126192 | A1 | 8/2013 |
| WO | 2013126193 | A1 | 8/2013 |
| WO | 2013126194 | A1 | 8/2013 |

OTHER PUBLICATIONS

International Search Report and Written Opinion for PCT/UC2013/023720 dated May 15, 2013.

International Search Report and Written Opinion for PCT/US2013/023709 dated May 30, 2013.

International Search Report and Written Opinion for PCT/US2013/023747 dated May 3, 2013.

International Search Report and Written Opinion for PCT/US2013/023736 dated May 14, 2013.

Official Action for European Patent Application No. 13751125.9 dated Jul. 20, 2015.

Supplementary European Search Report for EP Application No. 13751359.4 dated Dec. 10, 2015.

Official Action for Canadian Patent Application No. 2,860,440 dated Sep. 23, 2015.

ENHANCED EXPANDABLE TUBING RUN THROUGH PRODUCTION TUBING AND INTO OPEN HOLE

CROSS-REFERENCE TO RELATED APPLICATIONS

This present application claims priority to U.S. Provisional Patent App. No. 61/602,111 entitled "Extreme Expandable Packer and Downhole Construction," and filed on Feb. 23, 2012, the contents of which are hereby incorporated by reference in their entirety.

BACKGROUND

This present invention relates to wellbore completion operations and, more particularly, to a downhole completion assembly for sealing and supporting an open hole section of a wellbore and filtering fluids passing therethrough.

Oil and gas wells are drilled into the Earth's crust and extend through various subterranean zones before reaching producing oil and/or gas zones of interest. Some of these subterranean zones may contain water and it is often advantageous to prevent the subsurface water from being produced to the surface with the oil/gas. In some cases, it may be desirable to block gas production in an oil zone, or block oil production in a gas zone. Where multiple oil/gas zones are penetrated by the same borehole, it is sometimes required to isolate the several zones, thereby allowing separate and intelligent production control from each zone for most efficient production. In traditionally completed wells, where a casing string is cemented into the wellbore, external packers are commonly used to provide annular seals or barriers between the casing string and the centrally-located production tubing in order to isolate the various zones.

It is increasingly common, however, to employ completion systems in open hole sections of oil and gas wells. In these wells, the casing string is cemented only in the upper portions of the wellbore while the remaining portions of the wellbore remain uncased and generally open (i.e., "open hole") to the surrounding subterranean formations and zones. Open hole completions are particularly useful in slanted wellbores that have borehole portions that are deviated and run horizontally for thousands of feet through producing and non-producing zones. Some of the zones traversed by the slanted wellbore may be water zones which must be generally isolated from any hydrocarbon-producing zones. Moreover, the various hydrocarbon-producing zones often exhibit different natural pressures and must be intelligently isolated from each other to prevent flow between adjacent zones and to allow efficient production from the low pressure zones.

In open hole completions, annular isolators are often employed along the length of the open wellbore to allow selective production from, or isolation of, the various portions of the producing zones. As a result, the formations penetrated by the wellbore can be intelligently produced, but the wellbore may still be susceptible to collapse or unwanted sand production. To prevent the collapse of the wellbore and sand production, various steps can be undertaken, such as installing gravel packs and/or sand screens. More modern techniques include the use of expandable tubing in conjunction with sand screens. These types of tubular elements may be run into uncased boreholes and expanded once they are in position using, for example, a hydraulic inflation tool, or by pulling or pushing an expansion cone through the tubular members.

In some applications, the expanded tubular elements provide mechanical support to the uncased wellbore, thereby helping to prevent collapse. In other applications, contact between the tubular element and the borehole wall may serve to restrict or prevent annular flow of fluids outside the production tubing. However, in many cases, due to irregularities in the borehole wall or simply unconsolidated formations, expanded tubing and screens will not prevent annular flow in the borehole. For this reason, annular isolators, such as casing packers, are typically needed to stop annular flow. Use of conventional external casing packers for such open hole completions, however, presents a number of problems. They are significantly less reliable than internal casing packers, they may require an additional trip to set a plug for cement diversion into the packer, and they are generally not compatible with expandable completion screens.

Efforts have been made to form annular isolators in open hole completions by placing a rubber sleeve on expandable tubing and screens and then expanding the tubing to press the rubber sleeve into contact with the borehole wall. These efforts have had limited success due primarily to the variable and unknown actual borehole shape and diameter. Moreover, the thickness of the rubber sleeve must be limited since it adds to the overall tubing diameter, which must be small enough to extend through small diameters as it is run into the borehole. The maximum size is also limited to allow the tubing to be expanded in a nominal or even undersized borehole. On the other hand, in washed out or oversized boreholes, normal tubing expansion is not likely to expand the rubber sleeve enough to contact the borehole wall and thereby form a seal. To form an annular seal or isolator in variable sized boreholes, adjustable or variable expansion tools have been used with some success. Nevertheless, it is difficult to achieve significant stress in the rubber with such variable tools and this type of expansion produces an inner surface of the tubing which follows the shape of the borehole and is not of substantially constant diameter.

SUMMARY OF THE INVENTION

This present invention relates to wellbore completion operations and, more particularly, to a downhole completion assembly for sealing and supporting an open hole section of a wellbore and filtering fluids passing therethrough.

In some embodiments, a downhole completion system is disclosed. The system may include a sealing structure configured to be expanded from a contracted configuration to an expanded configuration, the sealing structure having one or more perforations defined therein, and a filter device arranged about the sealing structure so as to overlap at least one of the one or more perforations when the sealing structure is in the expanded configuration, the filter device being configured to screen fluids passing through the at least one of the one or more perforations.

In other embodiments, a method of completing an open hole section of a wellbore is disclosed. The method may include conveying a sealing structure in a contracted configuration to the open hole section, the sealing structure having one or more perforations defined therein and a filter device coupled to the sealing structure so as to overlap at least one of the one or more perforations; radially expanding the sealing structure to an expanded configuration with a deployment device when the sealing structure is arranged in the open hole section, the filter device being expandable with the sealing structure, and screening fluids passing through the at least one of the one or more perforations with the filter device.

The features and advantages of the present invention will be readily apparent to those skilled in the art upon a reading of the description of the preferred embodiments that follows.

BRIEF DESCRIPTION OF THE DRAWINGS

The following figures are included to illustrate certain aspects of the present invention, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

This present invention relates to wellbore completion operations and, more particularly, to a downhole completion assembly for sealing and supporting an open hole section of a wellbore and filtering fluids passing therethrough.

The present invention provides a downhole completion system that features an expandable sealing structure and corresponding internal truss structure that are capable of being run into a wellbore through existing production tubing and subsequently expanded to clad and support the inner surface of an open hole section of the wellbore. Once the sealing structure is run to its proper downhole location, it may be expanded by any number of fixed expansion tools that are also small enough to axially traverse the production tubing. In operation, the expanded sealing structure may be useful in sealing the inner radial surface of the open borehole, thereby preventing the influx of unwanted fluids, such as water. The internal truss structure may be arranged within the sealing structure and useful in supporting the expanded sealing structure. The truss structure also serves to generally provide collapse resistance to the corresponding open hole section of the wellbore. Once properly installed, the exemplary downhole completion system may stabilize, seal, and/or otherwise isolate the open hole section for long-term intelligent production operations.

The present invention further includes a filter device arranged about the outer circumferential surface of a perforated sealing structure. The filter device may be expandable with the sealing structure, and also able to axially traverse existing production tubing. During production operations, the filter device may prevent unwanted particulates from the surrounding subterranean formation from entering into the interior of the system. As will be apparent to those skilled in the art, the systems and methods disclosed herein may advantageously salvage or otherwise revive certain types of wells, such as watered-out wells, which were previously thought to be economically unviable.

Figure 1:
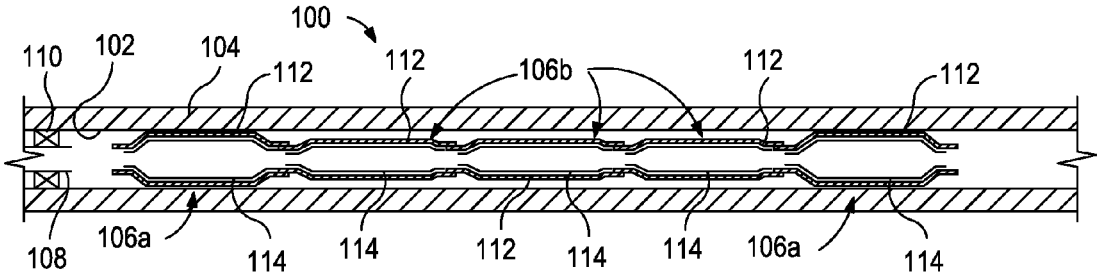
FIG. 1 illustrates an exemplary downhole completion system, according to one or more embodiments.

Referring to FIG. 1, illustrated is an exemplary downhole completion system 100, according to one or more embodiments disclosed. As illustrated, the system 100 may be configured to be arranged in an open hole section 102 of a wellbore 104. As used herein, the term or phrase "downhole completion system" should not be interpreted to refer solely to wellbore completion systems as classically defined or otherwise generally known in the art. Instead, the downhole completion system may also refer to or be characterized as a downhole fluid transport system. For instance, the downhole completion system 100, and the several variations described herein, may not necessarily be connected to any production tubing or the like. As a result, in some embodiments, fluids conveyed through the downhole completion system 100 may exit the system 100 into the open hole section 102 of the wellbore, without departing from the scope of the disclosure.

While FIG. 1 depicts the system 100 as being arranged in a portion of the wellbore 104 that is horizontally-oriented, it will be appreciated that the system 100 may equally be arranged in a vertical or slanted portion of the wellbore 104, or any other angular configuration therebetween, without departing from the scope of the disclosure. As illustrated, the downhole completion system 100 may include various interconnected sections or lengths extending axially within the wellbore 104. Specifically, the system 100 may include one or more end sections 106*a* (two shown) and one or more middle sections 106*b* (three shown) coupled to or otherwise generally interposing the end sections 106*a*. As will be described in more detail below, the end and middle sections 106*a,b* may be coupled or otherwise attached together at their respective ends in order to provide an elongate conduit or structure within the open hole section 102 of the wellbore 104.

While only two end sections 106*a* and three middle sections 106*b* are depicted in FIG. 1, it will be appreciated that the system 100 can include more or less end and middle sections 106*a,b* without departing from the scope of the disclosure and depending on the particular application and downhole needs. Indeed, the system 100 can be progressively extended by adding various sections thereto, such as additional end sections 106*a* and/or additional middle sections 106*b*. Additional end and/or middle sections 106*a,b* may be added until a desired or predetermined length of the system 100 is achieved within the open hole section 102. Those skilled in the art will recognize that there is essentially no limit as to how long the system 100 may be extended to, only being limited by the overall length of the wellbore 104, the size and amount of overlapping sections, finances, and/or time.

In some embodiments, the end sections 106*a* may be sized such that they expand to seal against or otherwise clad the inner radial surface of the open hole section 102 when installed, thereby providing a corresponding isolation point along the axial length of the wellbore 104. As discussed in greater detail below, one or more of the end sections 106*a* may include an elastomer or other sealing element disposed about its outer radial surface in order to sealingly engage the inner radial surface of the open hole section 102. The middle sections 106*b* may or may not be configured to seal against the inner radial surface of the open hole section 102. For example, in some embodiments, such as is illustrated in FIG. 1, one or more of the middle sections 106*b* may be characterized as "straddle" elements configured with a fixed outer diameter when fully expanded and not necessarily configured to seal against or otherwise engage the inner radial surface of the open hole section 102. Instead, such straddle elements may be useful in providing lengths of connective tubing or conduit for sealingly connecting the end sections 106*a* and providing fluid communication therethrough.

In other embodiments, one or more of the middle sections 106*b* may be characterized as "spanner" elements configured with a fixed outer diameter and intended to span a washout portion of the open hole section 102. In some embodiments, such spanner elements may exhibit variable sealing capabilities by having a sealing element (not shown) disposed about their respective outer radial surfaces. The sealing element may be configured to sealingly engage the inner radial surface of the open hole section 102 where washouts may be present. In yet other embodiments, one or more of the middle sections 106*b* may be characterized as "sealing" elements configured to, much like the end sections 106*a*, seal a portion of the wellbore 104 along the length of the open hole section 102. Such sealing elements may have an outer diameter that is matched (or closely matched) to a caliper log of the open hole section 102.

In contrast to prior art systems, which are typically run into the open hole section 102 via a cased wellbore 104, the disclosed downhole completion system 100 may be configured to pass through existing production tubing 108 extending within the wellbore 104. In some embodiments, the production tubing 108 may be stabilized within the wellbore 104 with one or more annular packers 110 or the like. As can be appreciated by those skilled in the art, the production tubing 108 exhibits a reduced diameter, which requires the system 100 to exhibit an even more reduced diameter during run-in in order to effectively traverse the length of the production tubing 108 axially. For example, a 4.5 inch outer diameter production tubing 108 in a nominal 6.125 inch inner diameter open hole section 102 would require that the downhole completion system 100 would need to have a maximum diameter of 3.6 inches to pass through the nipples on the production tubing 102 and must be able to expand between 6-7.5 inches in the open hole section 102. Such ranges of diameters in the open hole section 102 is needed to account for potential irregularities in the open hole section 102. Moreover, in order to properly seal against the open hole section 102 upon proper deployment from the production tubing 108, the system 100 may be designed to exhibit a large amount of potential radial expansion.

Each section 106*a,b* of the downhole completion system 100 may include at least one sealing structure 112 and at least one truss structure 114. In other embodiments, however, the truss structure 114 may be omitted from one or more of the sections 106*a,b*, without departing from the scope of the disclosure. In some embodiments, the sealing structure 112 may be configured to be expanded and clad the inner radial surface of the open hole section 102, thereby providing a sealing function within the wellbore 104. In other embodiments, the sealing structure 112 may simply provide a generally sealed conduit or tubular for the system 100 to be connected to adjacent sections 106*a,b*.

As illustrated, and as will be discussed in greater detail below, at least one truss structure 114 may be generally arranged within a corresponding sealing structure 112 and may be configured to radially support the sealing structure 112 in its expanded configuration. The truss structure 114 may also be configured to or otherwise be useful in supporting the wellbore 104 itself, thereby preventing collapse of the wellbore 104. While only one truss structure 114 is depicted within a corresponding sealing structure 112, it will be appreciated that more than one truss structure 114 may be used within a single sealing structure 112, without departing from the scope of the disclosure. Moreover, multiple truss structures 114 may be nested inside each other as there is adequate radial space in the expanded condition for multiple support structures 114 and be radially small enough to traverse the interior of the production tubing 108.

Figure 2A:
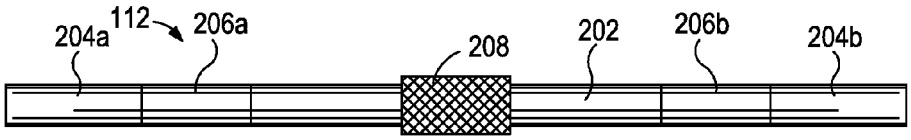
FIGS. 2A and 2B illustrate contracted and expanded sections of an exemplary sealing structure, according to one or more embodiments.
Figure 2B:
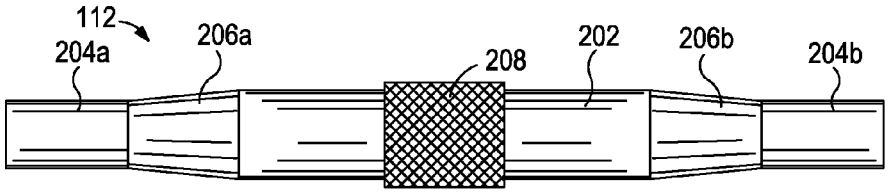

Referring now to FIGS. 2A and 2B, with continued reference to FIG. 1, illustrated is an exemplary sealing structure 112, according to one or more embodiments. Specifically, FIGS. 2A and 2B depict the sealing structure 112 in its contracted and expanded configurations, respectively. In its contracted configuration, as briefly noted above, the sealing structure 112 exhibits a diameter small enough to be run into the wellbore 104 through the reduced diameter of the production tubing 108. Once deployed from the production tubing 108, the sealing structure 112 is then able to be radially expanded into the expanded configuration.

In one or more embodiments, the sealing structure 112 may be an elongate tubular made of one or more metals or metal alloys. In other embodiments, the sealing structure 112 may be an elongate tubular made of thermoset plastics, thermoplastics, fiber reinforced composites, cementitious composites, combinations thereof, or the like. In embodiments where the sealing structure 112 is made of metal, the sealing structure 112 may be corrugated, crenulated, circular, looped, or spiraled. As depicted in FIGS. 2A and 2B, the sealing structure 112 is an elongate, corrugated tubular, having a plurality of longitudinally-extending corrugations or folds defined therein. Those skilled in the art, however, will readily appreciate the various alternative designs that the sealing structure 112 could exhibit, without departing from the scope of the disclosure. For example, in at least one embodiment, the sealing structure 112 may be characterized as a frustum or the like. In embodiments where the sealing structure 112 is made from corrugated metal, the corrugated metal may be expanded to unfold the corrugations or folds defined therein. In embodiments where the sealing structure 112 is made of circular metal, stretching the circular tube will result in more strain in the metal but will advantageously result in increased strength.

As illustrated, the sealing structure 112 may include or otherwise define a sealing section 202, opposing connection sections 204*a* and 204*b*, and opposing transition sections 206*a* and 206*b*. The connection sections 204*a,b* may be defined at either end of the sealing structure 112 and the transition sections 206*a,b* may be configured to provide or otherwise define the axial transition from the corresponding connector sections 204*a,b* to the sealing section 202, and vice versa. In at least one embodiment, each of the sealing section 202, connection sections 204*a,b*, and transition sections 206*a,b* may be formed or otherwise manufactured differently, or of different pieces or materials configured to exhibit a different expansion potential (e.g., diameter) when the sealing structure 112 transitions into the expanded configuration.

For instance, the corrugations (i.e., the peaks and valleys) of the sealing section 202 may exhibit a larger amplitude or frequency (e.g., shorter wavelength) than the corrugations of the connection sections 204*a,b*, thereby resulting in the sealing section 202 being able to expand to a greater diameter than the connection sections 204*a,b*. As can be appreciated, this may allow the various portions of the sealing structure 112 to expand at different magnitudes, thereby providing varying transitional shapes over the length of the sealing structure 112. In some embodiments, the various sections 202, 204*a,b*, 206*a,b* may be interconnected or otherwise coupled by welding, brazing, mechanical attachments, combinations thereof, or the like. In other embodiments, however, the various sections 202, 204*a,b*, 206*a,b* are integrally-formed in a single-piece manufacture.

In some embodiments, the sealing structure 112 may further include a sealing element 208 disposed about at least a portion of the outer radial surface of the sealing section 202. In at least one embodiment, an additional layer of protective material may surround the outer radial circumference of the sealing element 208 to protect the sealing element 208 as it is advanced through the production tubing 108. The protective material may further provide additional support to the sealing structure 112 configured to hold the sealing structure 112 under a maximum running diameter prior to placement and expansion in the wellbore 104. In operation, the sealing element 208 may be configured to expand as the sealing structure 112 expands and ultimately engage and seal against the inner diameter of the open hole section 102. In other embodiments, the sealing element 208 may provide lateral support for the downhole completion system 100 (FIG. 1). In some embodiments, the sealing element 208 may be arranged at two or more discrete locations along the length of the sealing section 202. The sealing element 208 may be made of an elastomer or a rubber, and may be swellable or non-swellable, depending on the application. In at least one embodiment, the sealing element 208 may be a swellable elastomer made from a mixture of a water swell and an oil swell elastomer.

In other embodiments, the material for the sealing elements 208 may vary along the sealing section 202 in order to create the best sealing available for the fluid type that the particular seal element may be exposed to. For instance, one or more bands of sealing materials can be located as desired along the length of the sealing section 202. The material used for the sealing element 208 may include swellable elastomeric, as described above, and/or bands of very viscous fluid. The very viscous liquid, for instance, can be an uncured elastomeric that will cure in the presence of well fluids. One example of such a very viscous liquid may include a silicone that cures with a small amount of water or other materials that are a combination of properties, such as a very viscous slurry of the silicone and small beads of ceramic or cured elastomeric material. The viscous material may be configured to better conform to the annular space between the expanded sealing structure 112 and the varying shape of the well bore 104 (FIG. 1). It should be noted that to establish a seal the material of the seal element 208 does not need to change properties, but only have sufficient viscosity and length in the small radial space to remain in place for the life of the well. The presence of other fillers, such as fibers, can enhance the viscous seal.

In other embodiments (not illustrated), the sealing element 208 is applied to the inner diameter of the open hole section 102 and may include such materials as, but not limited to, a shape memory material, swellable clay, hydrating gel, an epoxy, combinations thereof, or the like. In yet other embodiments, a fibrous material could be used to create a labyrinth-type seal between the outer radial surface of the sealing structure 112 and the inner diameter of the open hole section 102. The fibrous material, for example, may be any type of material capable of providing or otherwise forming a sealing matrix that creates a substantially tortuous path for any potentially escaping fluids. In yet further embodiments, the sealing element 208 is omitted altogether from the sealing structure 112 and instead the sealing section 202 itself is used to engage and seal against the inner diameter of the open hole section 102.

Figure 3A:
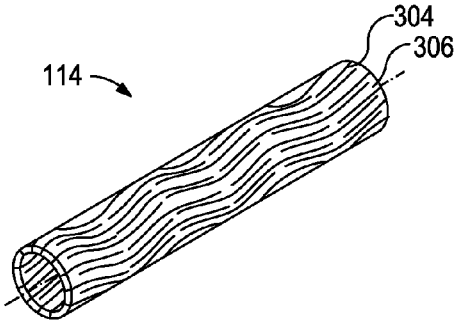
FIGS. 3A and 3B illustrate contracted and expanded sections of an exemplary truss structure, according to one or more embodiments.
Figure 3B:
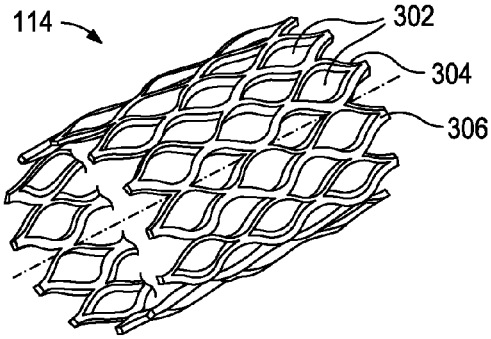

Referring now to FIGS. 3A and 3B, with continued reference to FIG. 1, illustrated is an exemplary truss structure 114, according to one or more embodiments. Specifically, FIGS. 3A and 3B depict the truss structure 114 in its contracted and expanded configurations, respectively. In its contracted configuration, the truss structure 114 exhibits a diameter small enough to be able to be run into the wellbore 104 through the reduced diameter production tubing 108. In some embodiments, the truss structure 114 in its contracted configuration exhibits a diameter small enough to be nested inside the sealing structure 112 when the sealing structure 112 is in its contracted configuration and able run into the wellbore 104 simultaneously through the production tubing 108. Once deployed from the production tubing 108, the truss structure 114 is then able to radially expand into its expanded configuration.

In some embodiments, the truss structure 114 may be an expandable device that defines or otherwise utilizes a plurality of expandable cells 302 that facilitate the expansion of the truss structure 114 from the contracted state (FIG. 3A) to the expanded state (FIG. 3B). In at least one embodiment, for example, the expandable cells 302 of the truss structure 114 may be characterized as bistable or multistable cells, where each bistable or multistable cell has a curved thin strut 304 connected to a curved thick strut 306. The geometry of the bistable/multistable cells is such that the tubular cross-section of the truss structure 114 can be expanded in the radial direction to increase the overall diameter of the truss structure 114. As the truss structure 114 expands radially, the bistable/multistable cells deform elastically until a specific geometry is reached. At this point the bistable/multistable cells move (e.g., snap) to an expanded geometry. In some embodiments, additional force may be applied to stretch the bistable/multistable cells to an even wider expanded geometry. With some materials and/or bistable/multistable cell designs, enough energy can be released in the elastic deformation of the expandable cell 302 (as each bistable/multistable cell snaps past the specific geometry) that the expandable cells 302 are able to initiate the expansion of adjoining bistable/multistable cells past the critical bistable/multistable cell geometry. With other materials and/or bistable/multistable cell designs, the bistable/multistable cells move to an expanded geometry with a nonlinear stair-stepped force-displacement profile.

At least one advantage to using a truss structure 114 that includes bistable/multistable expandable cells 302 is that the axial length of the truss structure 114 in the contracted and expanded configurations will be essentially the same. An expandable bistable/multistable truss structure 114 is thus designed so that as the radial dimension expands, the axial length of the truss structure 114 remains generally constant. Another advantage to using a truss structure 114 that includes bistable/multistable expandable cells 302 is that the expanded cells 302 are stiffer and will create a high collapse strength with less radial movement.

Whether bistable/multistable or not, the expandable cells 302 facilitate expansion of the truss structure 114 between its contracted and expanded configurations. The selection of a particular type of expandable cell 302 depends on a variety of factors including environment, degree of expansion, materials available, etc. Additional discussion regarding bistable/multistable devices and other expandable cells can be found in co-owned U.S. Pat. No. 8,230,913 entitled "Expandable Device for use in a Well Bore," the contents of which are hereby incorporated by reference in their entirety.

Figure 4A:
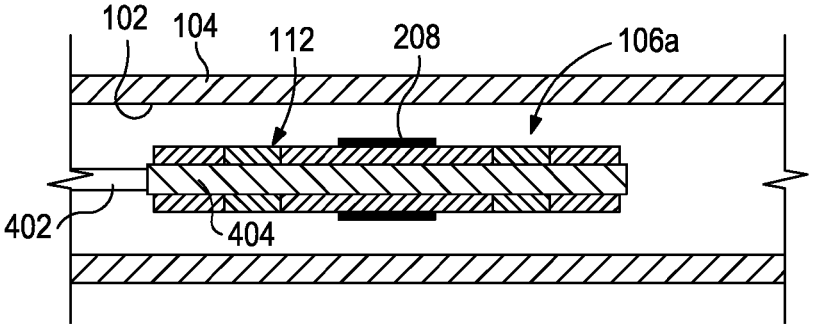
FIGS. 4A-4D illustrate progressive views of an end section of an exemplary downhole completion system being installed in an open hole section of a wellbore, according to one or more embodiments.

Referring now to FIGS. 4A-4D, with continued reference to FIGS. 1, 2A-2B, and 3A-3B, illustrated are progressive views of an end section 106*a* being installed or otherwise deployed within an open hole section 102 of the wellbore 104. While FIGS. 4A-4D depict the deployment or installation of an end section 106*a*, it will be appreciated that the following description could equally apply to the deployment or installation of a middle section 106*b*, without departing from the scope of the disclosure. As illustrated in FIG. 4A, a conveyance device 402 may be operably coupled to the sealing structure 112 and otherwise used to transport the sealing structure 112 in its contracted configuration into the open hole section 102 of the wellbore 104. As briefly noted above, the outer diameter of the sealing structure 112 in its contracted configuration may be small enough to axially traverse the axial length of the production tubing 108 (FIG. 1) without causing obstruction thereto. The conveyance device 402 may extend from the surface of the well and, in some embodiments, may be or otherwise utilize one or more mechanisms such as, but not limited to, wireline cable, coiled tubing, coiled tubing with wireline conductor, drill pipe, tubing, casing, combinations thereof, or the like.

Prior to running the sealing structure 112 into the wellbore 104, the diameter of the open hole section 102 may be measured, or otherwise callipered, in order to determine an approximate target diameter for sealing the particular portion of the open hole section 102. Accordingly, an appropriately-sized sealing structure 112 may be chosen and run into the wellbore 104 in order to adequately seal the inner radial surface of the wellbore 104.

A deployment device 404 may also be incorporated into the sealing structure 112 and transported into the open hole section 102 concurrently with the sealing structure 112 using the conveyance device 402. Specifically, the deployment device 404 may be operably connected or operably connectable to the sealing structure 112 and, in at least one embodiment, may be arranged or otherwise accommodated within the sealing structure 112 when the sealing structure 112 is in its contracted configuration. In other embodiments, the sealing structure 112 and the deployment device 404 may be run into the wellbore 104 separately, without departing from the scope of the disclosure. For example, in at least one embodiment, the sealing structure 112 and deployment device 404 may be axially offset from each other along the length of the conveyance device 402 as they are run into the wellbore 104. In other embodiments, the sealing structure 112 and deployment device 404 may be run-in on separate trips into the wellbore 104.

The deployment device 404 may be any type of fixed expansion tool such as, but not limited to, an inflatable balloon, a hydraulic setting tool (e.g., an inflatable packer element or the like), a mechanical packer element, an expandable swage, a scissoring mechanism, a wedge, a piston apparatus, a mechanical actuator, an electrical solenoid, a plug type apparatus (e.g., a conically shaped device configured to be pulled or pushed through the sealing structure 112), a ball type apparatus, a rotary type expander, a flexible or variable diameter expansion tool, a small diameter change cone packer, combinations thereof, or the like. Further description and discussion regarding suitable deployment devices 404 may be found in U.S. Pat. No. 8,230,913, previously incorporated by reference.

Figure 4B:
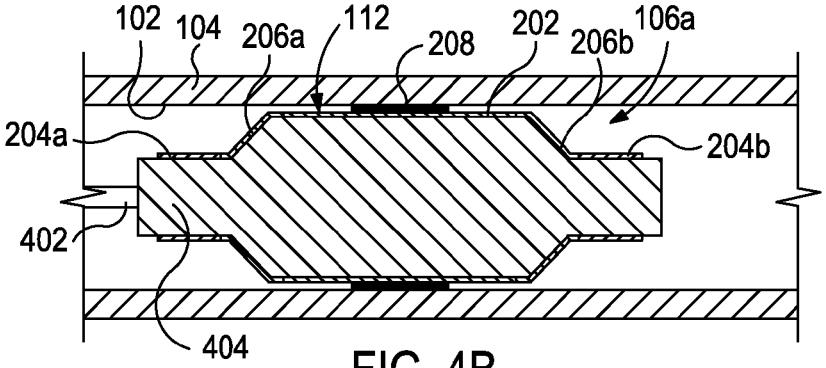

Referring to FIG. 4B, illustrated is the sealing structure 112 as it is expanded using the exemplary deployment device 404, according to one or more embodiments. In some embodiments, as illustrated, the sealing structure 112 is expanded until engaging the inner radial surface of the open hole section 102. The sealing element 208 may or may not be included with the sealing structure 112 in order to create an annular seal between the sealing structure 112 and the inner radial surface of the wellbore 104. As illustrated, the deployment device 404 may serve to deform the sealing structure 112 such that the sealing section 202, the connection sections 204*a,b*, and the transition sections 206*a,b* radially expand and thereby become readily apparent.

In embodiments where the deployment device 404 is a hydraulic setting tool, for example, the deployment device 404 may be inflated or otherwise actuated such that it radially expands the sealing structure 112. In such embodiments, the deployment device 404 may be actuated or otherwise inflated using an RDT™ (reservoir description tool) tool commercially-available from Halliburton Energy Services of Houston, Tex., USA. In other embodiments, the deployment device 404 may be inflated using fluid pressure applied from the surface or from an adjacent device arranged in the open hole section 102.

In one or more embodiments, the sealing structure 112 may be progressively expanded in discrete sections of controlled length. To accomplish this, the deployment device 404 may include short length expandable or inflatable packers designed to expand finite and predetermined lengths of the sealing structure 112. In other embodiments, the deployment device 404 may be configured to expand radially at a first location along the length of the sealing structure 112, and thereby radially deform or expand the sealing structure 112 at that first location, then deflate and move axially to a second location where the process is repeated. At each progressive location within the sealing structure 112, the deployment device 404 may be configured to expand at multiple radial points about the inner radial surface of the sealing structure 112, thereby reducing the number of movements needed to expand the entire structure 112.

Those skilled in the art will recognize that using short expansion lengths may help to minimize the chance of rupturing the sealing structure 112 during the expansion process. Moreover, expanding the sealing structure 112 in multiple expansion movements may help the sealing structure 112 achieve better radial conformance to the varying diameter of the open hole section 102.

In operation, the sealing structure 112 may serve to seal a portion of the open hole section 102 of the wellbore 104 from the influx of unwanted fluids from the surrounding subterranean formations. As a result, intelligent production operations may be undertaken at predetermined locations along the length of the wellbore 104. The sealing structure 112 may also exhibit structural resistive strength in its expanded form and therefore be used as a structural element within the wellbore 104 configured to help prevent wellbore 104 collapse. In yet other embodiments, the sealing structure 112 may be used as a conduit for the conveyance of fluids therethrough.

Figure 4C:
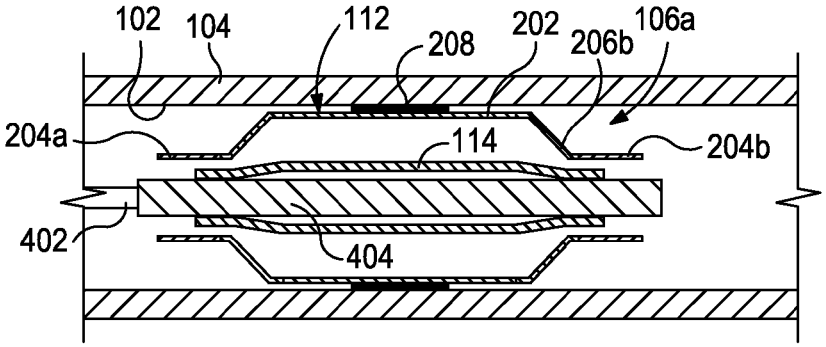

Referring to FIG. 4C, illustrated is the truss structure 114 in its contracted configuration as arranged within or otherwise being extended through the sealing structure 112. As with the sealing device 112, the truss structure 114 may be conveyed or otherwise transported to the open hole section 102 of the wellbore 104 using the conveyance device 402, and may exhibit a diameter in its contracted configuration that is small enough to axially traverse the production tubing 108 (FIG. 1). In some embodiments, the truss structure 114 may be run in contiguously or otherwise nested within the sealing structure 112 in a single run-in into the wellbore 104. However, such an embodiment may not be able to provide as much collapse resistance or expansion ratio upon deployment since the available volume within the production tubing 108 may limit how robust the materials are that are used to manufacture the sealing and truss structures 112, 114.

Accordingly, in other embodiments, as illustrated herein, the truss structure 114 may be run into the open hole section 102 independently of the sealing structure 112, such as after the deployment of the sealing structure 112, and otherwise during the course of a second run-in into the wellbore 104. This may prove advantageous in embodiments where larger expansion ratios or higher collapse ratings are desired or otherwise required within the wellbore 104. In such embodiments, the downhole completion system 100 may be assembled in multiple run-ins into the wellbore 104, where the sealing structure 112 is installed separately from the truss structure 114.

In order to properly position the truss structure 114 within the sealing structure 112, in at least one embodiment, the truss structure 114 may be configured to land on, for example, one or more profiles (not shown) located or otherwise defined on the sealing structure 112. An exemplary profile may be a mechanical profile on the sealing structure 112 which can mate with the truss structure 114 to create a resistance to movement by the conveyance 402. This resistance to movement can be measured as a force, as a decrease in motion, as an increase in current to the conveyance motor, as a decrease in voltage to the conveyance motor, etc. The profile may also be an electromagnetic profile that is detected by the deployment device 404. The electromagnetic profile may be a magnet or a pattern of magnets, an RFID tag, or an equivalent profile that determines a unique location.

In some embodiments, the profile(s) may be defined at one or more of the connection sections 204*a,b* which may exhibit a known diameter in the expanded configuration. The known expanded diameter of the connection sections 204*a,b*, may prove advantageous in accurately locating an expanded sealing structure 112 or otherwise connecting a sealing structure 112 to a subsequent or preceding sealing structure 112 in the downhole completion system 100. Moreover, having a known diameter at the connection sections 204*a,b* may provide a means whereby an accurate or precise location within the system 100 may be determined.

Figure 4D:
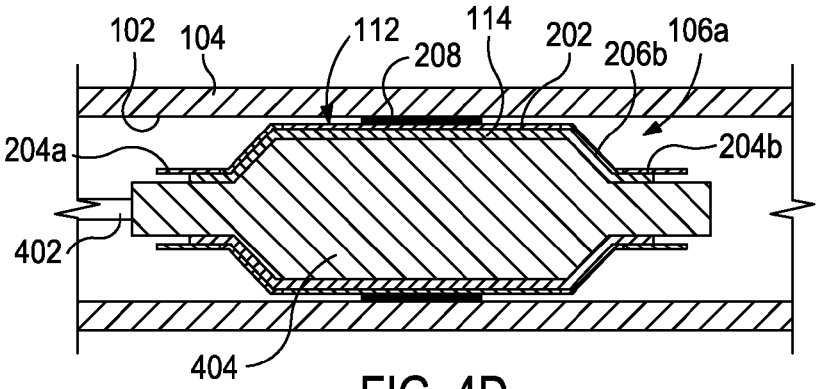

Referring to FIG. 4D, illustrated is the truss structure 114 as being expanded within the sealing device 112. Similar to the sealing device 112, the truss structure 114 may be forced into its expanded configuration using the deployment device 404. In at least one embodiment, the deployment device 404 is an inflatable packer element, and the inflation fluid used to actuate the packer element can be pumped from the surface through tubing or drill pipe, a mechanical pump, or via a downhole electrical pump which is powered via wireline cable.

As the deployment device 404 expands, it forces the truss structure 114 to also expand radially. In embodiments where the truss structure 114 includes bistable/multistable expandable cells 302 (FIG. 3B), at a certain expansion diameter the bistable/multistable expandable cells 302 reach a critical geometry where the bistable/multistable "snap" effect is initiated, and the truss structure 114 expands autonomously. Similar to the expansion of the sealing structure 112, the deployment device 404 may be configured to expand the truss structure 114 at multiple discrete locations. For instance, the deployment device 404 may be configured to expand radially at a first location along the length of the truss structure 114, then deflate and move axially to a second, third, fourth, etc., location where the process is repeated.

After the truss structure 114 is fully expanded, the deployment device 404 is radially contracted and removed from the deployed truss structure 114. In some embodiments, the truss structure 114 contacts the entire inner radial surface of the expanded sealing structure 112. In other embodiments, however, the truss structure 114 may be configured to contact only a few discrete locations of the inner radial surface of the expanded sealing structure 112.

In operation, the truss structure 114 in its expanded configuration supports the sealing structure 112 against collapse. In cases where the sealing structure 112 engages the inner radial surface of the wellbore 104, the truss structure 114 may also provides collapse resistance against the wellbore 104 in the open hole section 102. In other embodiments, especially in embodiments where the truss structure 114 employs bistable/multistable expandable cells 302 (FIG. 3B), the truss structure 114 may further be configured to help the sealing structure 112 expand to its fully deployed or expanded configuration. For instance, the "snap" effect of the bistable/multistable expandable cells 302 may exhibit enough expansive force that the material of the sealing structure 112 is forced radially outward in response thereto.

Figure 5:
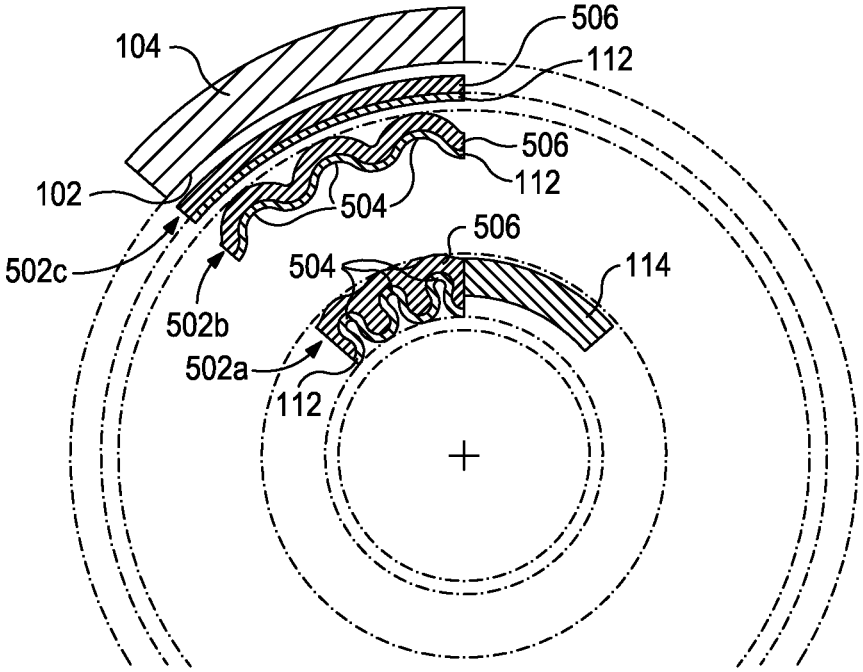
FIG. 5 illustrates a partial cross-sectional view of a sealing structure in its compressed, intermediate, and expanded configurations, according to one or more embodiments.

Referring now to FIG. 5, with continued reference to FIGS. 1, 2A-2B, and 4A-4B, illustrated is a cross-sectional view of an exemplary sealing structure 112 in progressive expanded forms, according to one or more embodiments. Specifically, the depicted sealing structure 112 is illustrated in a first unexpanded state 502*a*, a second expanded state 502*b*, and a third expanded state 502*c*, where the second expanded state 502*b* exhibits a larger diameter than the first unexpanded state 502*a*, and the third expanded state 502*c* exhibits a larger diameter than the second expanded state 502*b*. It will be appreciated that the illustrated sealing structure 112 may be representative of a sealing structure 112 that forms part of either an end section 106*a* or a middle section 106*b*, as described above with reference to FIG. 1, and without departing from the scope of the disclosure.

As illustrated, the sealing structure 112 may be made of a corrugated material, such as metal (or another pliable or expandable material), thereby defining a plurality of contiguous, expandable folds 504 (i.e., corrugations). Those skilled in the art will readily appreciate that corrugated tubing may simplify the expansion process of the sealing structure 112, extend the ratio of potential expansion diameter change, reduce the energy required to expand the sealing structure 112, and also allow for an increased final wall thickness as compared with related prior art applications. Moreover, as illustrated, the sealing structure 112 may have a sealing element 506 disposed about its outer radial surface. In other embodiments, however, as discussed above, the sealing element 506 may be omitted. In at least one embodiment, the sealing element 506 may be similar to the sealing element 208 of FIGS. 2A-2B, and therefore will not be described again in detail.

In the first unexpanded state 502*a*, the sealing structure 112 is in its compressed configuration and able to be run into the open hole section 102 of the wellbore 104 via the production tubing 108 (FIG. 1). The folds 504 allow the sealing structure 112 to be compacted into the contracted configuration, but also allow the sealing structure 112 to expand as the folds flatten out during expansion. For reference, the truss structure 114 is also shown in the first unexpanded state 502*a*. As described above, the truss structure 114 may also be able to be run into the open hole section 102 through the existing production tubing 108 and therefore is shown in FIG. 5 as having essentially the same diameter as the sealing structure 112 in their respective contracted configurations.

As will be appreciated by those skilled in the art, however, in embodiments where the truss structure 114 is run into the wellbore 104 simultaneously with the sealing structure 112, the diameter of the truss structure 114 in its contracted configuration would be smaller than as illustrated in FIG. 5. Indeed, in such embodiments, the truss structure 114 would exhibit a diameter in its contracted configuration small enough to be accommodated within the interior of the sealing structure 112.

In the second expanded state 502*b*, the sealing structure 112 may be expanded to an intermediate diameter (e.g., a diameter somewhere between the contracted and fully expanded configurations). As illustrated, in the second expanded state 502*b*, various peaks and valleys may remain in the folds 504 of the sealing structure 112, but the amplitude of the folds 504 is dramatically decreased as the material is gradually flattened out in the radial direction. In one or more embodiments, the intermediate diameter may be a predetermined diameter offset from the inner radial surface of the open hole section 102 or a diameter where the sealing structure 112 engages a portion of the inner radial surface of the open hole section 102.

Where the sealing structure 112 engages the inner radial surface of the open hole section 102, the sealing element 506 may be configured to seal against said surface, thereby preventing fluid communication either uphole or downhole with respect to the sealing structure 112. In some embodiments, the sealing element 506 may be swellable or otherwise configured to expand in order to seal across a range of varying diameters in the inner radial surface of the open hole section 102. Such swelling expansion may account for abnormalities in the wellbore 104 such as, but not limited to, collapse, creep, washout, combinations thereof, and the like. As the sealing element 506 swells or otherwise expands, the valleys of the sealing structure 112 in the second expanded state 502*b* may be filled in.

In the third expanded state 502*c*, the sealing structure 112 may be expanded to its fully expanded configuration or diameter. In the fully expanded configuration the peaks and valleys of the folds 504 may be substantially reduced or otherwise eliminated altogether. Moreover, in the expanded configuration, the sealing structure 112 may be configured to engage or otherwise come in close contact with the inner radial surface of the open hole section 102. As briefly discussed above, in some embodiments, the sealing element 506 may be omitted and the sealing structure 112 itself may instead be configured to sealingly engage the inner radial surface of the open hole section 102.

Referring now to FIGS. 6A-6D, with continued reference to FIGS. 1 and 4A-4D, illustrated are progressive views of building or otherwise extending the axial length of a downhole completion system 600 within an open hole section 102 of the wellbore 104, according to one or more embodiments of the disclosure. As illustrated, the system 600 includes a first section 602 that has already been successively installed within the wellbore 104. The first section 602 may correspond to an end section 106*a* (FIG. 1) and, in at least one embodiment, its installation may be representative of the description provided above with respect to FIGS. 4A-4D. In particular, the first section 602 may be complete with an expanded sealing structure 112 and at least one expanded truss structure 114 arranged within the expanded sealing structure 112. Those skilled in the art, however, will readily appreciate that the first section 602 may equally be representative of an expanded or installed middle section 106*b* (FIG. 1), without departing from the scope of the disclosure.

The downhole completion system 600 may be extended within the wellbore 104 by running one or more continuation or second sections 604 into the open hole section 102 and coupling the second section 604 to the distal end of an already expanded preceding section, such as the first section 602 (e.g., either an end or middle section 106*a,b*). While the second section 604 is depicted in FIGS. 6A-6D as representative of a middle section 106*b* (FIG. 1), those skilled in the art will again readily appreciate that the second section 604 may equally be representative of an expanded or installed end section 106*a* (FIG. 1), without departing from the scope of the disclosure.

As illustrated, the conveyance device 402 may again be used to convey or otherwise transport the sealing structure 112 of the second section 604 downhole and into the open hole section 102. The diameter of the sealing structure 112 in its contracted configuration may be small enough to pass through not only the existing production tubing 108 (FIG. 1), but the expanded first section 602. The sealing structure 112 of the second section 604 is run into the wellbore 104 in conjunction with the deployment device 404 which may be used to radially expand the sealing structure 112 upon actuation.

In one or more embodiments, the sealing structure 112 of the second section 604 may be run through the first section 602 such that the proximal connection section 204*a* of the second section 604 axially overlaps the distal connection section 204*b* of the first section 602 by a short distance. In other embodiments, however, the adjacent sections 602, 604 do not necessarily axially overlap at the adjacent connection sections 204*a,b* but may be arranged in an axially-abutting relationship or even offset a short distance from each other, without departing from the scope of the disclosure.

Figure 6A:
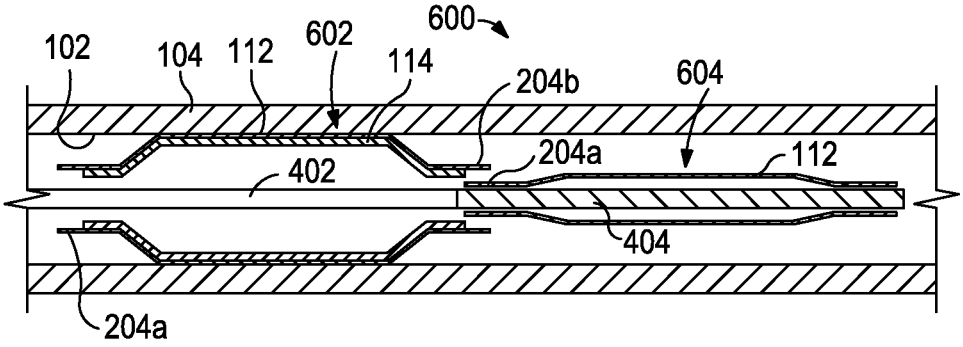
FIGS. 6A-6D illustrate progressive views of building the downhole completion system of FIG. 1 within an open hole section of a wellbore, according to one or more embodiments.
Figure 6B:
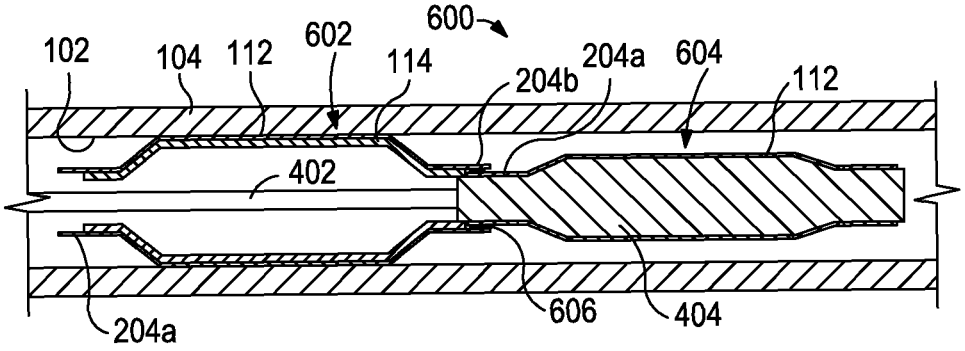

Referring to FIG. 6B, illustrated is the expansion of the sealing structure 112 of the second section 604 using the deployment device 404. In some embodiments, the sealing structure 112 of the second section 604 may be expanded to contact the inner radial surface of the open hole section 102 and potentially form a seal therebetween. In such embodiments, a sealing element (not shown), such as the sealing element 208 of FIGS. 2A and 2B, may be disposed about the outer radial surface of the sealing structure 112 in order to provide a seal over that particular area in the wellbore 104. In other embodiments, such as is illustrated, the sealing structure 112 is expanded to a smaller diameter. In such embodiments, no sealing element is required, thereby allowing for a thicker wall material and also minimizing costs.

As the sealing structure 112 of the second section 604 expands, its proximal connection section 204*a* expands radially such that its outer radial surface engages the inner radial surface of the distal connection section 204*b* of the first section 602, thereby forming a mechanical seal therebetween. In other embodiments, a sealing element 606 may be disposed about one or both of the outer radial surface of the proximal connection section 204*a* or the inner radial surface of the distal connection section 204*b*. The sealing element 606, which may be similar to the sealing element 208 described above (i.e., rubber, elastomer, swellable, non-swellable, etc.), may help form a fluid-tight seal between adjacent sections 602, 604. In some embodiments, the sealing element 606 serves as a type of glue between adjacent sections 602, 604 configured to increase the axial strength of the system 600.

Figure 6C:
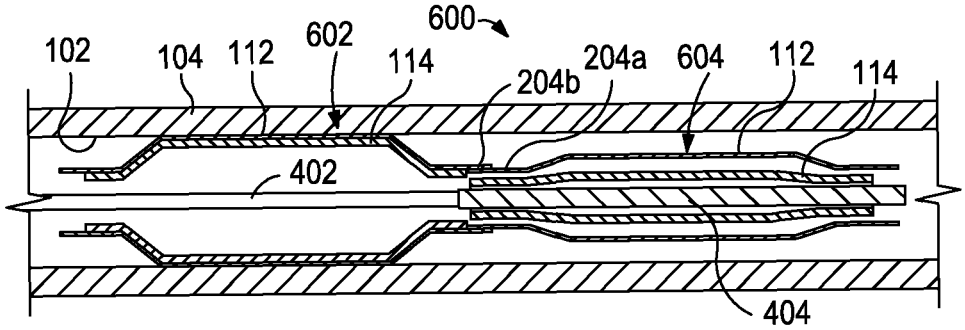

Referring to FIG. 6C, illustrated is a truss structure 114 in its contracted configuration being run into the wellbore 104 and the expanded sealing structure 112 of the second section 604 using the conveyance device 402. In its contracted configuration, the truss structure 114 exhibits a diameter small enough to traverse both the production tubing 108 (FIG. 1) and the preceding first section 602 without causing obstruction. In some embodiments, the truss structure 114 may be run in contiguously or otherwise nested within the sealing structure 112 in a single run-in into the wellbore 104. In other embodiments, however, as illustrated herein, the truss structure 114 may be run into the open hole section 102 independently of the sealing structure 112.

Figure 6D:
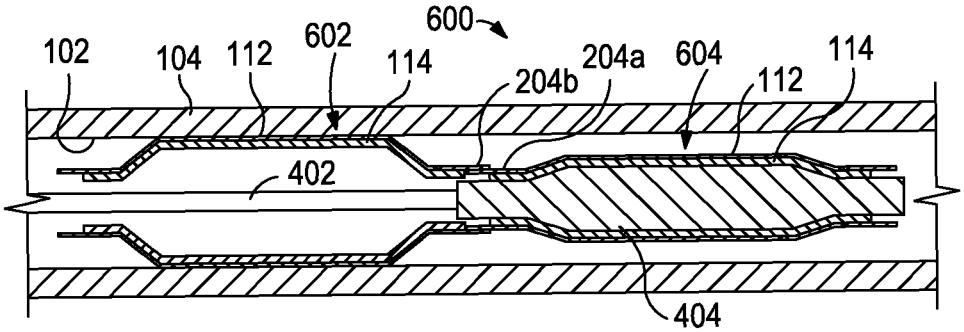

Referring to FIG. 6D, illustrated is the truss structure 114 as being expanded within the sealing device 112 using the deployment device 404. In its expanded configuration, the truss structure 114 provides radial support to the sealing structure 112 and may help prevent wellbore 104 collapse in the open hole section 102, where applicable.

Figure 7:
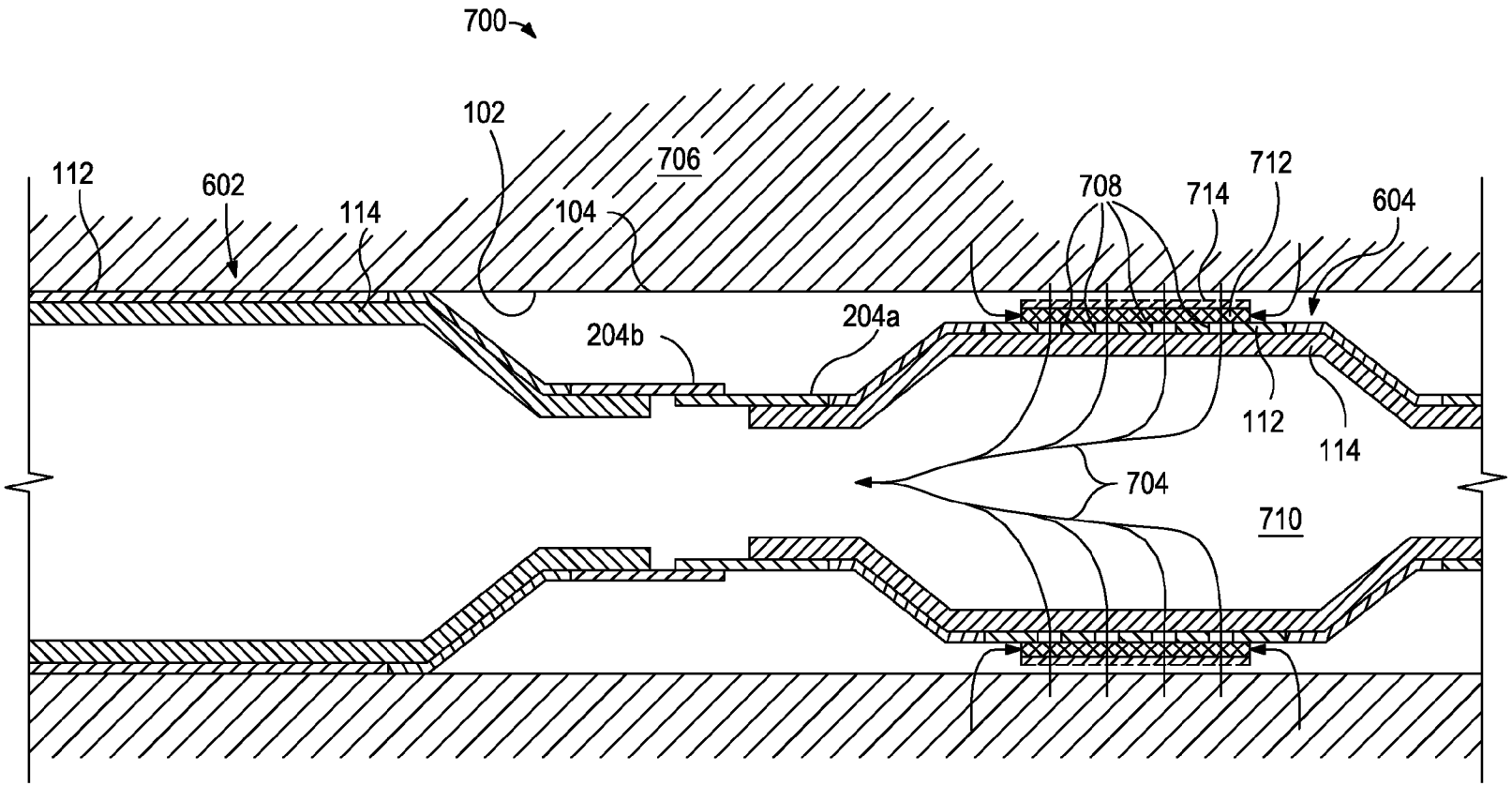
FIG. 7 illustrates a cross-sectional view of a portion of another exemplary downhole completion system, according to one or more embodiments.

Referring now to FIG. 7, illustrated is a cross-sectional view of a portion of another exemplary downhole completion system 700, according to one or more embodiments. The downhole completion system 700 may be similar in some respects to the downhole completion system 600 of FIGS. 6A-6D, and therefore may be best understood with reference thereto where like numerals indicate like elements not described again in detail. As illustrated, the system 700 includes a first section 602 arranged axially adjacent a second section 604, where the first and second sections 602, 604 have been successively installed within the wellbore 104 axially adjacent or otherwise proximate to one another. In some embodiments, the first section 602 may correspond to an end section 106*a* (FIG. 1) and the second section 604 may correspond to a middle section 106*b* (FIG. 1). In other embodiments, however, the first section 602 may correspond to either an end or middle section 106*a,b* and, likewise, the second section 604 may correspond to either an end or a middle section 106*a,b*, without departing from the scope of the disclosure.

Both the first and second sections 602, 604 may include an expanded sealing structure 112 and at least one expanded truss structure 114 arranged within the corresponding expanded sealing structure 112. In other embodiments, however, one or both of the expanded first or second sections 602, 604 may include only the expanded sealing structure 112, and the expanded truss structure 114 may otherwise be omitted from the respective section 602, 604, without departing from the scope of the disclosure.

In some embodiments, it may be desirable to produce fluids 704 from a surrounding subterranean formation 706 directly through one or more of the sealing structures 112, or otherwise inject fluids from the system 700 and into the formation 706. To accomplish this, in one or more embodiments, the sealing structure 112 of the second section 604 may define a plurality of perforations 708 configured to provide a corresponding number of planned flow paths for fluids 704 to communicate between the surrounding subterranean formation 706 and the interior 710 of the system 700. As a result, the system 700 may be able to strategically produce fluids from designated production intervals or zones along the wellbore 104 by strategically deploying the perforated sealing structure(s) 112 adjacent to such production intervals. Moreover, the system 700 may equally be able to strategically inject fluids into the formation 706 via the same deployment strategy. As illustrated, the perforations 708 are defined in the sealing section 202 (FIGS. 2A and 2B) of the sealing structure 112, but could equally be defined in one or both of the connection sections 204*a,b*, without departing from the scope of the disclosure. The perforations 708 may be created through several difference known methods such as, but not limited to, piercing, punching, boring, forming, cutting, abrading, eroding, or any other means known to the art.

In one or more embodiments, the system 700 may further include a filter device 712 arranged about or otherwise coupled to the outer surface of the perforated sealing section 112. In particular, the filter device 712 may be arranged so as to radially or otherwise axially overlap the plurality of perforations 708, thereby serving to screen out selected solids derived from the subterranean formation 706 during production operations. In other embodiments, two or more filter devices 712 may be arranged about the perforated sealing section 112 and configured to radially or axially overlap two corresponding sets of perforations 708. Moreover, although not shown, it is also contemplated herein to arrange the filter device 712 about or otherwise couple the filter device 712 to the inner circumferential surface of the perforated sealing section 112. In yet other embodiments, opposing filter devices 712 may be arranged on both the inner and outer circumferential surfaces of the perforated sealing section 112, without departing from the scope of the disclosure, thereby providing an added amount of filtration for production or injection operations.

The filter device 712 may be designed to restrict or stop movement of particulate matter, such as particulates of a defined size or larger, from the surrounding subterranean formation 706. In one embodiment, the filter device 712 may be a woven mesh structure made from, for example, cloth, linens, wire, other metal strands, plastics, composite materials, elastomers, combinations thereof, or the like. In other embodiments, the filter device 712 may be a packed structure including sized particles such as, but not limited to, gravel, beads, balls, combinations thereof, and the like. In yet other embodiments, the filter 712 device can be a sheet with flow passages such as perforations, slits, punches, combinations thereof, or the like. In even further embodiments, the filter device 712 may be an expandable wire wrap structure, such as a sand screen or the like. In yet even further embodiments, the filter device 712 may be a combination of one or more of the above-described types of filter devices 712, and otherwise may include multiple layers of such structures.

The filter device 712 may be configured such that it is able to be folded or otherwise compressed to a smaller diameter, such that it may be radially small enough to axially traverse the production tubing 108 (FIG. 1). Moreover, the filter device 712 may be radially expandable along with the sealing structure 112 once reaching the predetermined location for deployment within the wellbore 104. Consequently, the materials used to manufacture the filter device 712 may provide flexibility to the filter device 712 for expansion and/or deployment within the wellbore 104, and may also be designed to resist compaction from contact stress with the formation 706. The filter materials may also exhibit satisfactory temperature, fluid, and chemical resistance for the intended well and fluids encountered therein.

In one or more embodiments, the system 700 may optionally include a shroud 714 (shown in dashed) arranged at least partially about or otherwise coupled to the filter device 712. Similar to the filter device 712, the shroud 714 may be an expandable member but used to protect the filter device 712 from inadvertent damage as the system 700 is run into the wellbore 104. Alternatively, the shroud 714 may be configured to retain the filter material, such as a filter pack. In some embodiments, the shroud 712 may be made of an impermeable material or substance, thereby forcing any incoming fluids 704 from the subterranean formation 706 to enter at either end of the filter device 712 (or side(s) of the filter device 712) prior to passing through the plurality of perforations 708 and into the interior 710 of the system 700.

Along with the expansion of the sealing structure 112, as generally described above, the filter device 712 may be expanded to a tight configuration. Upon expansion, the plurality of elongate corrugations 504 (FIG. 5) defined in the sealing structure 112 may retain at least some degree of amplitude. As a result, and in operative conjunction with the optional shroud 714, these corrugations 504 may provide or otherwise define axial flow channels that collect and direct the incoming fluid 704 from the subterranean formation 706 toward the plurality of perforations 708. In other embodiments, longitudinal wires (not shown) may be arranged about the outer surface of the sealing structure 112, thereby equally forming the plurality of axial flow channels upon expanding the sealing structure 112.

In some embodiments, one or more of the perforations 708 may include a flow control device (not shown) operably arranged therein or otherwise coupled thereto. The flow control device(s) may be, but is not limited to, an inflow control device, an autonomous inflow control device, a valve (e.g., expandable-type, expansion-type, etc.), a sleeve, a sleeve valve, a sliding sleeve, a flow restrictor, a check valve (operable in either direction, in series or in parallel with other check valves, etc.), combinations thereof, or the like. In exemplary operation, the flow control device(s) may provide the option of preventing or otherwise restricting fluid flow 704 through the respective perforations 708 and into the interior 710 of the system 700. Alternatively, the flow control device(s) may be configured to regulate fluid flow 704 out of the interior 702 via the perforations 108, such as in an injection operation.

Accordingly, production and/or injection operations can be intelligently controlled at the perforations 708 via the corresponding flow control devices. In some embodiments, production/injection operations may be controlled by flow rate or pressure loss parameters, or both. In other embodiments, the production/injection operations may be restricted by several parameters of the fluid flow 704 such as, but not limited to, the flow rate, fluid density, viscosity, conductivity, or any combination of these. The controls, instructions, or relative configuration of each flow control device (e.g., valve position between open and closed positions) may be changed by wire line intervention or other standard oilfield practices.

In other embodiments, the flow control device(s) may be controlled using one or more intervention-less methods known to those skilled in the oil field completion technology. For example, the flow control device(s) may be remotely controlled by an operator (either wired or wirelessly) through means of a computer communicably coupled to each flow control device. The computer may have a processor and a computer-readable medium and, in some embodiments, may be configured to autonomously operate or actuate each flow control device in response to a signal perceived from an adjacent battery-powered or flow-powered device. Suitable actuators or solenoids may be also used to manipulate the flow rate of the flow control device(s) as directed by the computer or processor.

It should be noted that, while the filter device 712 is shown in FIG. 7 as being arranged about the perforated sealing structure 112 of the second section 604, the above discussion may equally apply to embodiments where the filter device 712, or any variation thereof, is used on a perforated sealing structure 112 of the first section 604, without departing from the scope of the disclosure.

In one or more embodiments, it may be advantageous or otherwise desired to seal the perforated sealing structure 112 such that fluid communication therethrough is substantially prevented. This may prove advantageous in embodiments where portions of the wellbore 104 are to be sealed in order to maximize production capabilities through other portions of the wellbore 104. In at least one embodiment, sealing the perforated sealing structure 112 may be accomplished by conveying an additional impermeable sealing structure (not shown) into the perforated sealing structure 112 and expanding the impermeable sealing structure therein, thereby effectively occluding the plurality of perforations 708.

Those skilled in the art will readily appreciate the several advantages the disclosed systems and methods may provide. For example, the disclosed downhole completion systems are able to be run through existing production tubing 108 (FIG. 1) and then deployed and/or assembled in an open hole section 102 of the wellbore 104. Accordingly, the production tubing 108 is not required to be pulled out of the wellbore 104 prior to installing the downhole completion systems, thereby saving a significant amount of time and expense. Another advantage is that the downhole completion systems can be run and installed without the use of a rig at the surface. Rather, the downhole completion systems may be extended into the open hole section 102 entirely on wireline, slickline, coiled tubing, or jointed pipe. Moreover, it will be appreciated that the downhole completion systems may be progressively built either toward or away from the surface within the wellbore 104, without departing from the scope of the disclosure. Even further, the final inner size of the expanded sealing structures 112 and truss structures 114 may allow for the conveyance of additional lengths of standard diameter production tubing through said structures to more distal locations in the wellbore.

Another advantage provided by the disclosed systems and methods is the filtering capabilities provided by the filter device 712 arranged about the sealing structure 112. With appropriate flow control devices accommodated within perforations defined in the sealing structure 112, the filter device 712 may be used to filter unwanted particulates from entering the production stream and the flow control devices may intelligently regulate such production streams. The filter device 712 and associated flow control devices, therefore, may provide a planned flow path for fluids to communicate between the surrounding subterranean formation and the interior of the downhole completion systems. Such flow control devices may be manually or autonomously operated in order to optimize hydrocarbon production.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patents or other documents that may be incorporated herein by reference, the definitions that are consistent with this specification should be adopted.

The invention claimed is:

1. A downhole completion system, comprising:

a sealing structure expandable from a contracted configuration to an expanded configuration and having one or more perforations defined therein;

a filter device arranged about the sealing structure and overlapping at least one of the one or more perforations when the sealing structure is in the expanded configuration to screen fluids passing through the at least one of the one or more perforations; and an impermeable shroud arranged about the filter device and having opposing open axial ends to direct the fluids through an end of the filter device.

2. The system of claim 1, further comprising one or more flow control devices coupled to at least one of the one or more perforations and configured to regulate fluid flow through the at least one of the one or more perforations.

3. The system of claim 1, wherein the filter device is expandable with the sealing structure.

4. The system of claim 2, wherein the one or more flow control devices are selected from the group consisting of an inflow control device, an autonomous inflow control device, a valve, a sleeve, a sleeve valve, a flow restrictor, a check valve, and combinations thereof.

5. The system of claim 1, further comprising a truss structure configured to be expanded from a contracted configuration to an expanded configuration when arranged at least partially within the sealing structure.

6. The system of claim 5, further comprising:

a conveyance device configured to transport the sealing structure and truss structures in their respective contracted configurations through the production tubing and to an open hole section of the wellbore; and a deployment device configured to radially expand the sealing and truss structures from their respective contracted configurations to their respective expanded configurations.

7. The system of claim 5, wherein, when in the expanded configuration, the truss structure radially supports the sealing structure.

8. The system of claim 5, wherein the truss structure is an expandable device that defines a plurality of expandable cells that facilitate expansion of the truss structure from the contracted configuration to the expanded configuration.

9. The system of claim 8, wherein at least one of the plurality of expandable cells comprises a thin strut connected to a thick strut, and wherein an axial length of the truss structure in the contracted and expanded configurations is generally the same.

10. The system of claim 1, wherein the sealing structure is a first sealing structure, the system further comprising a second sealing structure configured to be expanded within the first sealing structure, the second sealing structure being impermeable and thereby configured to occlude at least some of the one or more perforations.

11. A method of completing an open hole section of a wellbore, comprising:

conveying a sealing structure in a contracted configuration to the open hole section, the sealing structure having one or more perforations defined therein and a filter device coupled to the sealing structure and overlapping at least one of the one or more perforations, the sealing structure further including an impermeable shroud arranged about the filter device and having opposing open axial ends;

radially expanding the sealing structure to an expanded configuration with a deployment device when the sealing structure is arranged in the open hole section, the filter device and the shroud being expandable with the sealing structure;

directing fluids into an end of the filter device through the opposing open axial ends of the impermeable shroud; and screening the fluids passing through the at least one of the one or more perforations with the filter device.

12. The method of claim 11, further comprising regulating a flow of the fluids through the at least one of the one or more perforations with one or more flow control devices coupled to the at least one of the one or more perforations.

13. The method of claim 11, wherein screening fluids passing through the one or more perforations comprises screen fluids entering the sealing structure via the one or more perforations with the filter device.

14. The method of claim 11, wherein screening fluids passing through the one or more perforations comprises screen fluids exiting the sealing structure via the one or more perforations with the filter device.

15. The method of claim 11, further comprising:

conveying a truss structure in a contracted configuration to the open hole section of the wellbore;

radially expanding the truss structure into an expanded configuration while arranged at least partially within the sealing structure; and radially supporting the sealing structure with the truss structure.

16. The method of claim 14, further comprising conveying the sealing structure and the truss structure in their respective contracted configurations through production tubing arranged within the wellbore.

17. The method of claim 16, wherein radially expanding the truss structure to the expanded configuration further comprises expanding a plurality of expandable cells defined on the truss structure.

18. The method of claim 17, wherein expanding the plurality of expandable cells further comprises radially expanding the truss structure such that an axial length of the truss structure in the contracted and expanded configurations is generally the same.

19. The method of claim 11, wherein the sealing structure is a first sealing structure, the method further comprising:

conveying a second sealing structure to and at least partially within the first sealing structure, the second sealing structure being impermeable; and expanding the second sealing structure such that at least some of the one or more perforations in the first sealing structure are occluded.

* * * * *